US005160389A

United States Patent [19]

Akiyama et al.

[11] Patent Number: 5,160,389

[45] Date of Patent: Nov. 3, 1992

[54] FLEXIBLE TUBE FOR AUTOMOTIVE EXHAUST SYSTEMS

[75] Inventors: Shunichiro Akiyama, Jyoetsu; Hisao Fujikawa, Nishinomiya, both of Japan

[73] Assignees: Nippon Stainless Steel Co., Ltd., Tokyo; Sumitomo Metal Industries, Ltd., Osaka, both of Japan

[21] Appl. No.: 732,770

[22] Filed: Jul. 19, 1991

Related U.S. Application Data

[63] Continuation of Ser. No. 476,721, Jan. 24, 1990, abandoned.

[51] Int. Cl.[5] ..... C22C 38/44

[52] U.S. Cl. ..... 148/327; 420/52; 420/53; 420/584.1; 148/909

[58] Field of Search ..... 420/52, 53, 584; 148/327, 909

[56] References Cited

U.S. PATENT DOCUMENTS 4,530,720 7/1985 Moroishi et al. ..... 420/584

4,892,704 1/1990 Sawaragi ..... 148/327

*Primary Examiner*—Deborah Yee

*Attorney, Agent, or Firm*—Burns, Doane, Swecker & Mathis

[57] ABSTRACT

A flexible tube for the exhaust system of an automobile made from a stainless steel is disclosed, which consists essentially of, by weight %:

| | |
|---|---|
| C: at most 0.03%, | Si: 0.1–2.0%, |
| Mn: at most 2.0%, | Cr: 18–26%, |
| Ni: 16–30%, | Mo: 1.0–3.0%, |
| Ti: 0–0.25%, | Nb: 0–1.5%, and |

a remainder of Fe and incidental impurities, of the impurities, the amount of oxygen being ≦50 ppm, the amount of S being ≦20 ppm, and the amount of P being ≦150 ppm, and the amounts of O, S, and P satisfying the formula $$1350 > 25X\ \text{Oxygen} + 20XS + P\ (\text{ppm}).$$

12 Claims, 2 Drawing Sheets

FLEXIBLE TUBE FOR AUTOMOTIVE EXHAUST SYSTEMS

This application is a continuation of application Ser. No. 07/476,721 filed Jan. 24, 1990, now abandoned.

This invention relates to a flexible tube for use in automotive exhaust systems. In particular, it relates to a flexible tube having excellent formability, corrosion resistance, and high-temperature fatigue strength.

Automotive exhaust systems include various tubular members such as exhaust manifolds, flexible tubes, mufflers, and tail pipes. In the past, these members have been made form cast steel, Al-plated steel, or stainless steel, depending on the required properties. A high degree of heat resistance and corrosion resistance is required of these members, so it is most common for them to be made of heat-resistant stainless steel.

Flexible tubes for exhaust systems must have good corrosion resistance (pitting resistance, SCC resistance, high-temperature corrosion resistance), high-temperature fatigue strength, corrosion fatigue resistance, formability, and weldability, and because they are manufactured in vast quantities, they must be economical. However, conventional stainless steels for flexible tubes can not satisfy all of these requirements.

Presently, austenite stainless steels such as AISI 304 are used for flexible tubes. However, when they are employed for flexible tubes in automobiles which operate in cold climates where the roads are salted in winter, salt from the roads builds up on the inside of the heat shields with which the flexible tubes are normally covered, and corrosion due to chlorides at high temperatures becomes a problem. When flexible tube is used in such severe conditions, the corrosion resistance of conventional stainless steels is inadequate.

As flexible tubes have complicated shapes, they require a material having good formability in addition to good high-temperature corrosion resistance, corrosion fatigue resistance and fatigue strength.

The Ni alloy called Alloy 600 is able to satisfy many of the physical requirements for flexible tubes, but it is extremely expensive, so it is not suitable for mass production.

Various steels having good high-temperature corrosion resistance in the presence of chlorides have been proposed. For example, Japanese Published Unexamined Patent Application No. 60-230966 corresponding to U.S. Pat. No. 4,742,324 discloses a steel which contains at least one of Mo, V, and W and which has excellent corrosion resistance at high temperatures in the presence of chlorides. That steel is intended for use in sheath heaters, which must have resistance to so-called dry corrosion. The amounts of the impurities S and P in that steel should be as low as possible and are limited to at most 0.003% and 0.02%, respectively. However, that publication makes no mention of the formability or the high-temperature fatigue strength of the steel.

Japanese Published Unexamined Patent Application No. 63-213643 discloses a steel which achieves corrosion resistance in a high-temperature environment in the presence of chlorides by employing fine particles with a crystal grain size number of at least 6. The amounts of S and P in that steel are preferably at most 0.03% each, and in the examples of that publication, the amounts of S and P range from 0.01–0.03%.

However, while the above-described conventional steels are said to have good corrosion resistance at high temperatures in the presence of chlorides, the corrosion resistance as well as corrosion fatigue resistance of those steels when used as flexible tubes in wet high-temperature environments in the presence of chlorides has never been evaluated.

Furthermore, the formability as well as the thermal fatigue strength of these steels have not been evaluated. In general, a high Si content is used in steels in order to improve high-temperature corrosion resistance, so such steels are thought to have poor formability.

In addition, the above-described patent publications only refer to the amounts of the impurities S and P. They contain no description of the effects of oxygen and the effects of these elements when present in extremely small quantities.

SUMMARY OF THE INVENTION

Accordingly, it is an object of the present invention to provide a flexible tube for use in automotive exhaust systems which can be formed into complicated shapes and which has excellent resistance to corrosion and thermal fatigue.

It is another object of the present invention to provide a flexible tube for automotive exhaust systems which is made of an inexpensive material and which is suitable for mass production.

A flexible tube for automotive exhaust systems according to the present invention is made from a stainless steel consisting essentially of, by weight %:

| | |
|---|---|
| C: at most 0.03%, | Si: 0.1–2.0%, |
| Mn: at most 2.0%, | Cr: 18–26%, |
| Ni: 16–30%, | Mo: 1.0–3.0%, |
| Ti: 0–0.25%, | Nb: 0–1.5%, and |

a remainder of Fe and incidental impurities, of the impurities, the amount of oxygen being $\leqq 50$ ppm, the amount of S being $\leqq 20$ ppm, and the amount of P being $\leqq 150$ ppm, and the amounts of oxygen, S, and P satisfying the formula:

$$1350 > 25 \times \text{Oxygen} + 20 \times S + P \text{ (Oxygen, P,S: ppm).}$$

DESCRIPTION OF THE PREFERRED EMBODIMENTS

Figure 1:
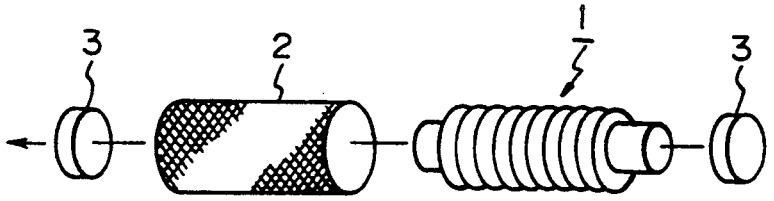
FIG. 1 is an exploded perspective view showing a flexible tube for an automotive exhaust system according to this invention.

The reasons for the limits on the components of the present invention will now be explained. In the following description, unless otherwise indicated, % refers to weight %.

C

C (carbon) is effective for maintaining the high-temperature strength of steel. However, when chlorides adhere to a steel, the presence of carbon greatly decreases the high-temperature corrosion resistance and also worsens the weldability of the steel. This tendency is particularly pronounced when the carbon content is greater than 0.03%. Therefore, according to the present invention, the C content is limited to at most 0.03% and preferably is at most 0.02%.

Si

Si can improve the corrosion resistance of steel at high temperatures in the presence of chlorides, and it is also effective as a deoxidizing agent. It is not effective when present in amounts of less than 0.1%, while if its content exceeds 2.0%, the weldability of an all-austenite steel with a high Ni content is worsened, and the precipitation of $\sigma$ phase is promoted, so the ductility and toughness of the steel deteriorate after extended use at a high temperature. Therefore, the Si content is limited to 0.1-2.0%.

Mn

Mn is necessary in order to maintain the hot workability of steel. If the Mn content is greater than 2.0%, the corrosion resistance of the steel at high temperatures in the presence of chlorides is deteriorated, so the Mn content should be at most 2.0%. Preferably, it is 0.1-1.5%.

Cr

Cr improves the resistance to high-temperature corrosion in the presence of chlorides and the general oxidation resistance in the vicinity of 900° C. However, it is not effective when added in an amount of less than 18%. In general, the higher the Cr content, the greater the resistance to high-temperature oxidation, but its effectiveness saturates at around 26%. Furthermore, if the Cr content is too high, it becomes necessary to add a large amount of Ni in order to maintain a single austenite phase, to prevent deterioration by aging, and to maintain the weldability of the steel, and a large Ni content makes the steel uneconomical. Therefore, the Cr content is 18-26%.

Ni

Ni is an important component, since it is extremely effective for improving corrosion resistance at high temperatures in the presence of chlorides. Its presence is also important for maintaining a single austenite phase. It must be added in an amount of at least 16% to adequately display these effects. In general, the higher the Ni content, the greater is the high-temperature corrosion resistance. However, as Ni is expensive, its content significantly affects the cost of the steel, so for reasons of economy, the upper limit on its content is 30%.

Mo

Like Ni, Mo is expensive, and is extremely effective for increasing corrosion resistance at high temperatures in the presence of chlorides. For this purpose, it is more than 10 times as effective as Ni. Mo provides excellent effects when added in an amount of at least 1.0%, and the greater the content, the greater its effect. However, the additional effect when it is added in excess of 3.0% is not commensurate to its cost, and when it is added in large amounts, it is necessary to increase the content of Ni in order to maintain phase stability, resulting in an expensive steel. Therefore, the content of Mo is 1.0%-3.0%, and preferably 1.5-3.0%.

Normally, V and W are thought to be equivalent to Mo for providing high-temperature strenth, but from the standpoint of formability, they are inadequate and are therefore not employed for flexible tubes according to the present invention.

Ti and Nb

Ti may be added if desired to improve the high-temperature strength of the steel. It is effective when present in an amount of at least 0.05%. However, when its content exceeds 0.25%, the thermal fatigue strength of steel markedly deteriorates. Therefore, the upper limit on the Ti content is 0.25%.

Like Ti, Nb may be added if desired in order to improve the high-temperature strength of the steel. The upper limit on its content is 1.5%. Preferably, the Nb content is 0.05-1.5%.

Thus, if desired, at least one of Ti: 0.05-0.25% and Nb: 0.05-1.5% may be added to further improve the high temperature strength.

S, P, and Oxygen

S, P, and oxygen are present as incidental impurities. The amount of oxygen should be $\leqq 50$ ppm, and preferably $\leqq 40$ ppm, the amount of S $\leqq 20$ ppm, preferably $\leqq 10$ ppm, and the amount of P $\leqq 150$ ppm, preferably $\leqq 130$ ppm, while the amounts of these elements expressed in ppm should satisfy the formula: $1350 > 25 \times \text{Oxygen} + 20 \times S + P$ in order to improve the toughness and formability, increase the cleanness, and improve the resistance to thermal fatigue of the steel. Preferably, the formula is $970 > 25 \times \text{Oxygen} + 20 \times S + P$. If S, P, and oxygen are present in excess of the above-defined amounts, adequate improvement in these properties can not be achieved. In particular, the cleanness of the steel deteriorates when the amounts of oxygen and S exceed the above-described limits.

FIG. 1 is a schematic, exploded perspective view showing a flexible tube according to the present invention. As shown in this figure, the flexible tube 1 is enclosed by a heat-shielding mesh cover 2 made of stainless steel. A ring 3 is disposed at each end of the tube to fix the mesh cover. The flexible tube 1 is formed into a shape of bellows, and is subjected to vibration, i.e., a repeated stress and high-temperature corrosion. It can be understood why a high degree of formability, thermal fatigue strength and corrosion resistance are required of the flexible tube.

The present invention will now be described in greater detail by means of the following working examples.

EXAMPLES

Steel test pieces having the composition shown in Table 1 were subjected to various tests to evaluate their corrosion resistance, high-temperature fatigue strength, formability, and weldability. The test results are shown in Table 2. The test procedures are described below. For comparison, test pieces made of a conventional AISI 304 stainless steel and Alloy 600 were subjected to the same tests. The test results for the conventional materials are also given in Table 2.

PITTING CORROSION RESISTANCE

In accordance with JIS G 0577, the test pieces were immersed in a 0.5M NaCl solution at 80° C., and the pitting corrosion potential (Vc') was measured.

SCC RESISTANCE

U-shaped test pieces were immersed in a boiling 30% MgCl aqueous solution containing $Cl^-$ ions in an amount corresponding to that of a saturated solution of a deicer to determine the SCC resistance.

HIGH-TEMPERATURE CORROSION RESISTANCE

Test pieces with a thickness of 0.25 mm were immersed in a simulated deicer-containing solution for 10 minutes, heated at 700° C. for 80 minutes, and then cooled in air for 10 minutes. This 100-minute cycle was repeated 20 times, after which the depth of corrosion in mm was measured as an indication of high-temperature corrosion resistance.

HIGH-TEMPERATURE FATIGUE STRENGTH

A rotating bending fatigue test was carried out. A test piece which had been placed in an atmosphere at 700° C. was subjected to $10^7$ rotations at 3,000 rpm. The maximum load at rupture was taken as the high-temperature fatigue strength.

FROMABILITY

The formability was evaluated on the basis of the elongation of a test piece in a conventional tensile test and the breaking strength in an Erichsen test.

WELDABILITY

Test pieces with a thickness of 0.25 mm were welded by a TIG arc welding method. The weldability was determined on the basis of the welded joint efficiency.

CORROSION RESISTANCE OF WELD ZONE:

Welded test pieces with a thickness of 0.25 mm were immersed in the above-described boiling 30% MgCl aqueous solution to determine high temperature corrosion resistance of the weld zone.

It can be seen form Table 2 that the steels employed in the present invention can satisfy the requirements that the $Vc'_{100}$ is higher than 0.15 volts, the thermal fatigue strength is 17 kgf/mm$^2$ or higher, preferably 20 kgf/mm$^2$ or higher, and the tensile elongation is 40% or larger. Therefore, the flexible tube of the present invention can be used in cold climates advantageously.

In contrast, the high temperature corrosion resistance and the high temperature fatigue strength of AISI 304 steel and Alloy 600 are inadequate for them to be used as flexible tubes for use in automotive exhaust systems. In particular, Alloy 600 is expensive, and the pitting corrosion resistance as well as formability of the base and the weld zone of Alloy 600 are inadequate.

Figure 2:
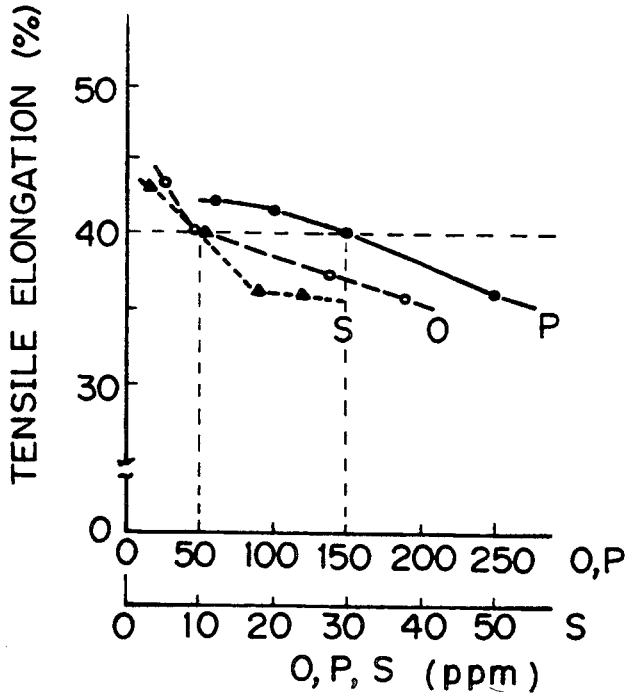
FIGS. 2–4 are graphs showing the results of tests performed on a steel for use in the present invention.

FIG. 2 is a graph showing the effects of the content of the incidental impurities oxygen, S, and P on the tensile elongation of the resulting steel.

Figure 3:
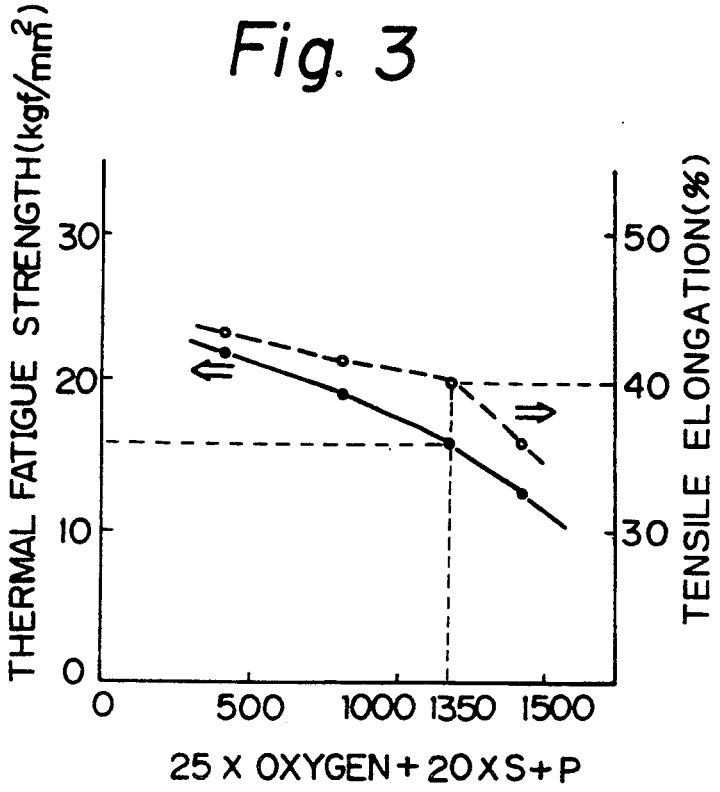

FIG. 3 is a graph showing the criticality of the range defined by the formula: $1350 > 25 \times \text{Oxygen} + 20 \times S + P$ (ppm).

Figure 4:
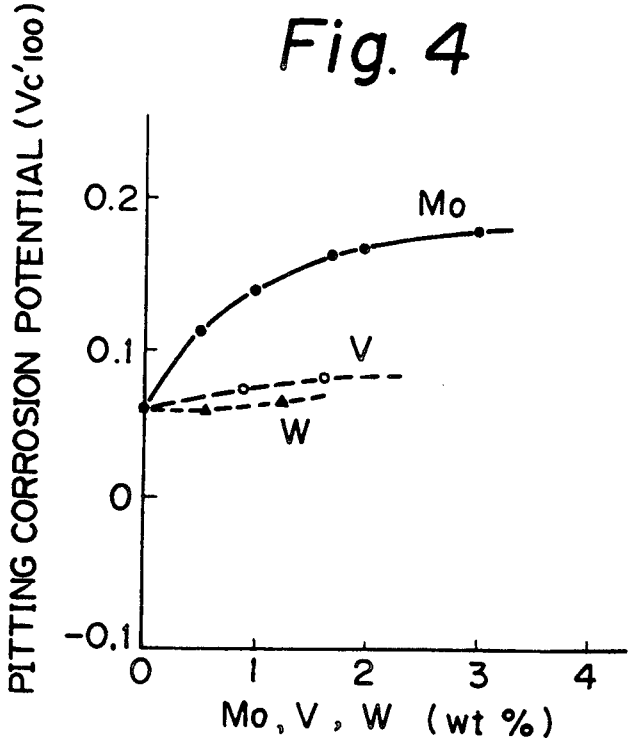

FIG. 4 shows the effect of the content of Mo, V, and W on the pitting corrosion resistance of the resulting steel.

Based on the results of the above-described tests, the following observations can be made.

(1) The overall characteristics of the steel employed in the present invention makes the resulting flexible tube more practical than flexible tube made from AISI 304 steel or Alloy 600.

(2) The impurities oxygen, S, and P have significant effects.

(3) In a steel for use as a flexible tube, V and W are not equivalents of Mo.

TABLE I

| | Steel No. | C | Si | Mn | Cr | Ni | Mo | Ti | Nb | Oxygen (ppm) | S (ppm) | P (ppm) | Others |
|---|---|---|---|---|---|---|---|---|---|---|---|---|---|
| This Invention | 1 | 0.010 | 1.2 | 0.5 | 19.1 | 18.4 | 1.3 | — | — | 20 | 7 | 118 | — |
| | 2 | 0.028 | 0.9 | 1.2 | 23.6 | 21.5 | 2.2 | — | — | 15 | 5 | 101 | — |
| | 3 | 0.004 | 1.5 | 0.7 | 18.5 | 28.2 | 2.8 | — | — | 40 | 4 | 60 | — |
| | 4 | 0.011 | 1.0 | 1.4 | 22.2 | 19.1 | 1.7 | 0.10 | — | 25 | 9 | 130 | — |
| | 5 | 0.011 | 0.8 | 1.1 | 22.1 | 20.5 | 2.3 | — | 0.25 | 31 | 9 | 125 | — |
| Comparative | 6 | 0.045 | 0.9 | 1.1 | 20.5 | 22.2 | 1.7 | — | — | 41 | 9 | 110 | — |
| | 7 | 0.022 | 2.6 | 0.8 | 22.8 | 18.8 | 2.3 | — | — | 38 | 8 | 128 | — |
| | 8 | 0.015 | 0.6 | 0.7 | 16.0 | 13.5 | 2.0 | — | — | 20 | 15 | 100 | — |
| | 9 | 0.021 | 1.1 | 1.2 | 21.4 | 23.0 | 0.7 | — | — | 28 | 12 | 95 | — |
| | 10 | 0.025 | 1.0 | 0.5 | 18.8 | 20.5 | 1.9 | — | — | 30 | 52 | 110 | — |
| | 11 | 0.014 | 1.6 | 0.8 | 19.5 | 22.6 | 2.3 | — | — | 45 | 17 | 145 | 25 Oxygen + 20S + P = 1470 |
| | 12 | 0.020 | 1.2 | 1.2 | 21.0 | 23.3 | 2.0 | — | — | 120 | 11 | 250 | — |
| Conventional | AISI 304 | 0.055 | 0.6 | 0.5 | 18.5 | 8.5 | — | — | — | 70 | 15 | 260 | — |
| | Alloy 600 | 0.026 | 0.4 | 0.4 | 15.9 | Bal. | — | 0.25 | — | 45 | 75 | 140 | Al: 0.12, Fe: 7.5 |

Note:
(1) Compositions are expressed in weight % other than for oxygen, P, and S.
(2) The underlines indicate the case which falls outside the range of this invention.

TABLE 2

| | Steel No. | Corrosion Resistance: (Vc' 100)*1 | Corrosion Resistance: SCC Resistance | Corrosion Resistance: High Temp. Corrosion (Depth, mm) | Thermal Fatigue Strength (kgf/mm$^2$) | Formability: El. (%) | Formability: (mm)*2 | Weldability: (%)*3 | Weldability: High Temp. Corrosion (Depth, mm) |
|---|---|---|---|---|---|---|---|---|---|
| This Invention | 1 | 0.17 | No crack | 0.08 | 20 | 48 | 12.0 | 91.0 | 0.08 |
| | 2 | 0.17 | " | 0.06 | 21 | 43 | 11.4 | 89.2 | 0.07 |
| | 3 | 0.20 | " | 0.04 | 23 | 42 | 11.1 | 88.1 | 0.04 |
| | 4 | 0.18 | " | 0.05 | 20 | 48 | 12.3 | 92.0 | 0.05 |
| | 5 | 0.19 | " | 0.05 | 22 | 42 | 12.1 | 89.1 | 0.05 |
| Comparative | 6 | 0.14 | " | 0.16 | 14 | 40 | 10.4 | 88.8 | Through |

TABLE 2-continued

| | Steel No. | Corrosion Resistance (Vc' 100)*1 | SCC Resistance | High Temp. Corrosion (Depth, mm) | Thermal Fatigue Strength (kgf/mm²) | Formability El. (%) | Formability (mm)*2 | Weldability (%)*3 | Weldability High Temp. Corrosion (Depth, mm) |
|---|---|---|---|---|---|---|---|---|---|
| | 7 | 0.18 | " | 0.04 | 18 | 38 | 9.8 | 72.2 | 0.05 |
| | 8 | 0.15 | Cracking | 0.22 | 13 | 44 | 12.2 | 99.2 | Through |
| | 9 | 0.15 | No crack | 0.12 | 16 | 42 | 12.0 | 97.0 | 0.21 |
| | 10 | 0.20 | " | 0.04 | 16 | 38 | 10.1 | 86.5 | 0.06 |
| | 11 | 0.18 | " | 0.05 | 15 | 36 | 9.6 | 90.1 | 0.07 |
| | 12 | 0.17 | " | 0.06 | 16 | 36 | 9.8 | 91.5 | 0.08 |
| Conventional | AISI 304 | −0.01 | Cracking | Through | 12 | 60 | 12.4 | 99.8 | Through |
| | Alloy 600 | 0.10 | No crack | 0.02 | 26 | 33 | 9.2 | 66.6 | 0.02 |

Note:
*1Pitting Corrosion Potential.
*2Erichsen Value,
*3Joint Efficiency.
The underlines indicate that properties are inadequate for the purpose of this invention.

What is claimed is:

1. A flexible tube for the exhaust system of an automobile made from a stainless steel consisting essentially of, by weight %:

| | |
|---|---|
| C: at most 0.03%, | Si: 0.1-2.0%, |
| Mn: at most 2.0%, | Cr: 18-26%, |
| Ni: 16-30%, | Mo: 1.0-3.0%, |
| Ti: 0-0.25%, | Nb: 0-1.5%, and |

a remainder of Fe and incidental impurities, of the impurities, the amount of oxygen being ≦50 ppm, the amount of S being ≦20 ppm, and the amount of P being ≦150 ppm, and the amounts of oxygen, S, and P satisfying the formula $$1350 > 25 \times \text{Oxygen} + 20 \times S + P \text{ (ppm)}.$$

2. A flexible tube as claimed in claim 1 wherein the amount of C is at most 0.02%.

3. A flexible tube as claimed in claim 1 wherein the amount of Mn is 0.1-1.5%.

4. A flexible tube as claimed in claim 1 wherein the amount of oxygen is at most 40 ppm, the amount of S is at most 10 ppm, and the amount of P is at most 130 ppm.

5. A flexible tube for the exhaust system of an automobile made form a stainless steel consisting essentially of, by weight %:

| | |
|---|---|
| C: at most 0.03%, | Si: 0.1-2.0%, |
| Mn: at most 2.0%, | Cr: 18-26%, |
| Ni: 16-30%, | Mo: 1.0-3.0%, and |

a remainder of Fe and incidental impurities, of the impurities, the amount of oxygen being ≦50 ppm, the amount of S being ≦20 ppm, and the amount of P being ≦150 ppm, and the amounts of oxygen, S, and P satisfying the formula:

$$1350 > 25 \times \text{Oxygen} + 20 \times S + P \text{ (ppm)}.$$

6. A flexible tube as claimed in claim 5 wherein the amount of C is at most 0.02%.

7. A flexible tube as claimed in claim 5 wherein the amount of Mn is 0.1-1.5%.

8. A flexible tube as claimed in claim 5 wherein the amount of oxygen is at most 40 ppm, the amount of S is at most 10 ppm, and the amount of P is at most 130 ppm.

9. A flexible tube for the exhaust system of an automobile made from a stainless steel consisting essentially of, by weight %:

| | |
|---|---|
| C: at most 0.03%, | Si: 0.1-2.0%, |
| Mn: at most 2.0%, | Cr: 18-26%, |
| Ni: 16-30%, | Mo: 1.0-3.0%, |

at least one of Ti: 0.05-0.25% and Nb: 0.05-1.5%, and a remainder of Fe and incidental impurities, of the impurities, the amount of oxygen being ≦50 ppm, the amount of S being ≦20 ppm, and the amount of P being ≦150 ppm, and the amounts of oxygen, S, and P satisfying the formula:

$$1350 > 25 \times \text{Oxygen} + 20 \times S + P \text{ (ppm)}.$$

10. A flexible tube as claimed in claim 9 wherein the amount of C is at most 0.02%.

11. A flexible tube as claimed in claim 9 wherein the amount of Mn is 0.1-1.5%.

12. A flexible tube as claimed in claim 9 wherein the amount of oxygen is at most 40 ppm, the amount of S is at most 10 ppm, and the amount of P is at most 130 ppm.

* * * * *